US006556117B1

(12) United States Patent
Nakao et al.

(10) Patent No.: US 6,556,117 B1
(45) Date of Patent: Apr. 29, 2003

(54) MULTI-CHANNEL UNIFORM OUTPUT TYPE TRANSFORMER

(75) Inventors: Fumiaki Nakao, Kosai (JP); Satoshi Ohta, Hamana-gun (JP); Mikio Kitaoka, Arai-machi (JP); Katsuo Yamada, Hamamatsu (JP); Hiroshi Sakamoto, Kumamoto (JP)

(73) Assignee: FDK Corporation, Tokyo (JP)

( * ) Notice: Subject to any disclaimer, the term of this patent is extended or adjusted under 35 U.S.C. 154(b) by 69 days.

(21) Appl. No.: 09/639,214

(22) Filed: Aug. 15, 2000

(30) Foreign Application Priority Data

Aug. 26, 1999 (JP) ..... 11-239852
May 10, 2000 (JP) ..... 2000-136988

(51) Int. Cl.[7] ..... H01F 17/00

(52) U.S. Cl. ..... 336/105; 336/200; 336/232; 336/225; 336/25

(58) Field of Search ..... 336/105, 25, 223, 336/136, 200, 232; 363/123; 315/291

(56) References Cited

U.S. PATENT DOCUMENTS 4,395,693 A * 7/1983 Marinescu ..... 336/223
5,781,093 A * 7/1998 Grandmont et al. ..... 336/232
5,982,264 A 11/1999 Nakao et al. ..... 336/200
6,060,976 A * 5/2000 Yamaguchi et al. ..... 336/200
6,087,992 A * 7/2000 Smith ..... 336/223

FOREIGN PATENT DOCUMENTS

JP 11-176483 7/1999

OTHER PUBLICATIONS

Merriam Webster's Collegiate Dictionary, Tenth Edition, p. 14.*

* cited by examiner

*Primary Examiner*—Karl D. Easthom
*Assistant Examiner*—Jennifer A Poker
(74) *Attorney, Agent, or Firm*—Arter & Hadden LLP

(57) ABSTRACT

A multi-channel output type transformer for outputting uniformly balanced voltage among multiple output channels. The transformer comprising a primary winding and a secondary winding that is wound round a winding shaft portion of a core. The secondary winding of the transformer is a flat cable belt comprising covered conductors corresponding to the number of output channels. The cable belts are arranged in parallel. A plane loop is formed by appropriately folding the flat cable belt, and the plane loop member is arranged to as to substantially orthogonally intersect the winding shaft of the core.

22 Claims, 11 Drawing Sheets

MULTI-CHANNEL UNIFORM OUTPUT TYPE TRANSFORMER

BACKGROUND OF THE INVENTION

1. Technical Field of the Invention

The present invention relates to a transformer to be applied to a switching power unit for charging a battery group in, for example, an electric automobile, and more particularly to a multi-channel uniform output type transformer for obtaining output at the same level from a multiplicity of secondary windings.

2. Description of the Prior Art

In, for example, the electric automobile, a power source obtained by series connecting as many secondary batteries as 200 or more is used as a driving power source. It is not simple to uniformly and efficiently charge these many batteries, but concerning a charging system, various technical development has been pursued. As one of them, such a charging system as shown in FIG. 11 has been proposed.

According to this system, the multi-channel uniform output type transformer 1 is used for a charging apparatus, and each channel output 31 of the transformer is connected in parallel to each battery 21 of a series battery 20 to individually charge each battery 21.

As described above, a driving power source for electric automobiles is obtained by connecting 200 or more secondary batteries in series. If, therefore, each single battery 21 has a difference in capacity because of an individual difference of each battery 21, temperature distribution within a packed battery 20 and the like, the electric power of some batteries having smaller capacity becomes the electric power of each battery to shorten the life of the batteries. In other words, even if there is any slight difference in capacity between each battery, it can lead to big power loss as a whole. Therefore, it is important in the multi-channel uniform output type transformer to make the output voltage of each channel uniform with a very high degree of accuracy.

In addition to the above described problem to make the output voltage uniform, there is also a problem in the manufacture that a conductor to be used for the secondary winding must be wound a number of times corresponding to the number of output channels. More specifically, if as many conductors as 200 are wound round the core at the same time, it becomes difficult to distinguish a winding start from winding close of each conductor, and to bring a pair of output ends of one conductor into correspondence with each other. Further, since lead pins are normally connected to the starting end and closing end of each conductor, the cost required for the process will become higher.

SUMMARY OF THE INVENTION

Therefore, it is an object of the present invention to provide a multi-channel uniform output type transformer capable of making the output balance of each channel very uniform, and contributing to reduced cost by simplifying the winding process.

The present invention relates to a multi-channel uniform output type transformer, and according to a first aspect of the invention, there is provided a multi-channel uniform output type transformer wherein a secondary winding is a flat cable belt comprising covered conductors corresponding to a number of the output channels arranged in parallel, a plane loop member is formed by appropriately folding the flat cable belt, and this plane loop member is arranged so as to substantially orthogonally intersect the winding shaft of the core.

According to a second aspect of the invention, there is provided a multi-channel uniform output type transformer wherein the plane loop member is formed by folding the flat cable belt odd-numbered times. According to a third aspect of the invention, there is provided a multi-channel uniform output type transformer specified in the second aspect, wherein the plane loop member is formed by overlapping the winding start and winding close end portions of each conductor included in the flat cable belt in such a manner that the both end portions are adjacent to each other respectively.

According to a fourth aspect of the invention, there is provided a multi-channel uniform output type transformer wherein a plurality of the plane loop members are formed by a plurality of the flat cable belts, and each plane loop member is arranged so as to become substantially concentric circle-shaped on the same plane substantially orthogonal to the winding shaft. According to a fifth aspect of the invention, there is provided a multi-channel uniform output type transformer wherein a plurality of the similar plane loop members are formed by a plurality of the flat cable belts, and each plane loop member is arranged in deviated relationship with each other in parallel in directions that are substantially orthogonal to each of interlinkage magnetic field loops induced on the core by the winding shaft and the primary winding.

According to a sixth aspect of the invention, there is provided a multi-channel uniform output type transformer wherein the flat cable belt is supported at the farthest position from a gap of the core.

According to a seventh aspect of the invention, there is provided a multi-channel uniform output type transformer wherein a collectively pressure welding type flat cable connector is fixed on a substrate and at least one end portion of the flat cable belt is connected to the connector.

According to an eighth aspect of the invention, there is provided a multi-channel uniform output type transformer wherein axial type diodes of the same number as the number of the output systems are substantially vertically installed and fixed on the substrate, and one lead pin of the diode on the cathode side or the anode side is installed on the substrate while the other lead pin is connected to each conductor of one end portion of the flat cable belt. According to a ninth aspect of the invention, there is provided a multi-channel uniform output type transformer specified in the eighth aspect, wherein diodes of the same number as the number of the output systems are integrated in a line for each diode of an appropriate number to be divided into a plurality of diode rows, each diode row is vertically provided on the substrate at appropriate intervals in parallel with each other, and one end portion of the flat cable belt is appropriately cut, and each of the conductors is connected to a predetermined diode of the appropriate diode rows.

According to a tenth aspect of the invention, there is provided a multi-channel uniform output type transformer specified in any of the above described seventh to ninth aspects of the invention, wherein the substrate is used as a printed circuit substrate, the circuit substrate concerned is supported by the winding shaft portion of the core, and the plane loop belt is arranged on this circuit substrate surface.

According to an eleventh aspect of the invention, there is provided a multi-channel uniform output type transformer wherein the primary winding and secondary winding are used as a sheet coil. In the eleventh aspect of the invention, the primary winding is a primary sheet coil comprising one printed circuit formed in a loop shape or in a helical shape on the substrate; the secondary winding is a secondary sheet coil, comprising folded printed circuits, which correspond to patterns obtained by folding back printed circuits corresponding to the number of output channels, alternately formed on the front and back surfaces of the substrate, and comprising the folded printed circuits continuously connected via a throughhole for each output channel; and each of these sheet coils is stacked and arranged so as to substantially orthogonally intersect the winding shaft of the core.

According to a twelfth aspect of the invention, there is provided a multi-channel uniform output type transformer wherein the secondary sheet coil is formed by a multi-layer substrate. Concretely, the secondary winding is a stacked substrate type secondary sheet coil comprising printed circuits corresponding to the number of output channels continuously connected via throughholes while the printed circuits are being formed into folded patterns in each layer of the multi-layer substrate.

According to a thirteenth aspect of the invention, there is provided a multi-channel uniform output type transformer specified in the eleventh or twelfth aspect of the invention, wherein when a printed circuit formed on a certain surface of the substrate is connected to a printed circuit of the folded pattern formed on another surface, a number of times of folding in the secondary sheet coil is counted, and the number of times of folding is set to an odd number.

According to a fourteenth aspect of the invention, there is provided a multi-channel uniform output type transformer specified in any of the eleventh to thirteenth aspects of the invention, wherein the printed circuit pattern of the secondary sheet coil is a line-symmetrical diagram as it is seen through from one substrate surface.

According to a fifteenth aspect of the invention, there is provided a multi-channel uniform output type transformer specified in any of the eleventh to fourteenth aspects of the invention, wherein the primary sheet coil is pinched between the two secondary sheet coils described and the distance between each sheet coil is made constant.

According to a sixteenth aspect of the invention, there is provided a multi-channel uniform output type transformer specified in the fifteenth aspect of the invention, wherein the primary sheet coil is arranged in coincidence with the position of a gap of the core.

According to a seventeenth aspect of the invention, there is provided a multi-channel uniform output type transformer specified in the fifteenth or sixteenth aspect of the invention, wherein the printed circuit patterns of the two secondary sheet coils for pinching the primary sheet coil therebetween are plane-symmetrical to each other with respect to the primary sheet coil.

According to an eighteenth aspect of the invention, there is provided a multi-channel uniform output type transformer specified in any of the fifteenth to seventeenth aspects of the invention, wherein lead pins are vertically provided on both sides of the substrate of the primary sheet coil, the lead pins concerned are inserted through positioning hole portions formed on the two substrates of the secondary sheet coils for fixing, whereby a distance between each sheet coil is maintained to be the predetermined distance.

According to a nineteenth aspect of the invention, there is provided a multi-channel uniform output type transformer specified in any of the eleventh to eighteenth aspects of the invention, wherein plane packaging type diodes of the same number as the number of output systems are packaged on one surface of the substrate of the secondary sheet coil, and one lead terminal on the cathode side or on the anode side of the diode is connected to a printed circuit portion corresponding to the end portion of the secondary winding on this packaged surface.

In this nineteenth aspect of the invention, there are some cases where the winding start end portion and the winding close end portion of the secondary winding are separated into the front and back surfaces of the substrate respectively to be formed, such as when the secondary sheet coil is folded odd-numbered times. According to a twentieth aspect of the invention, there is provided a multi-channel uniform output type transformer, wherein two lead terminals (anode and cathode) of the diode are connected to printed circuit portions corresponding to the winding start end portion and the winding close end portion of the secondary windings of their respective adjacent systems via the throughholes formed on the substrate.

BRIEF DESCRIPTION OF THE DRAWINGS

FIG. 4A shows a case where diodes are placed in a row for packaging; and FIG. 4B shows a case where diodes are placed in two rows for packaging;

FIG. 5A is its perspective view and FIG. 5B shows its sectional view;

FIG. 6A shows the pattern of the printed circuit of the primary sheet coil; FIG. 6B shows the pattern of the printed circuit of the secondary sheet coil as a plan view from the substrate surface; FIG. 6C shows the pattern of the printed circuit on the back surface of the substrate of the secondary sheet coil as a perspective view through the substrate surface; and FIG. 6D is a view obtained by overlapping wiring patterns shown in FIGS. 6B and 6C;

FIG. 7A is a plan view showing the substrate surface; and FIG. 6B is a perspective view through the substrate surface;

FIG. 8A is a plan view showing each sheet coil to be stacked one another; and FIG. 8B is a side view showing the stacked state of each sheet coil;

FIG. 9A is a plan view showing a printed circuit pattern on the substrate surface; and FIG. 9B is a perspective view showing a printed circuit pattern on the back surface of the substrate through the substrate surface;

DETAILED DESCRIPTION OF THE PREFERRED EMBODIMENTS

[Embodiments of the Invention]

First Embodiment (Flat Cable Belt Type)

<Schematic Structure of Transformer>

Figure 1:
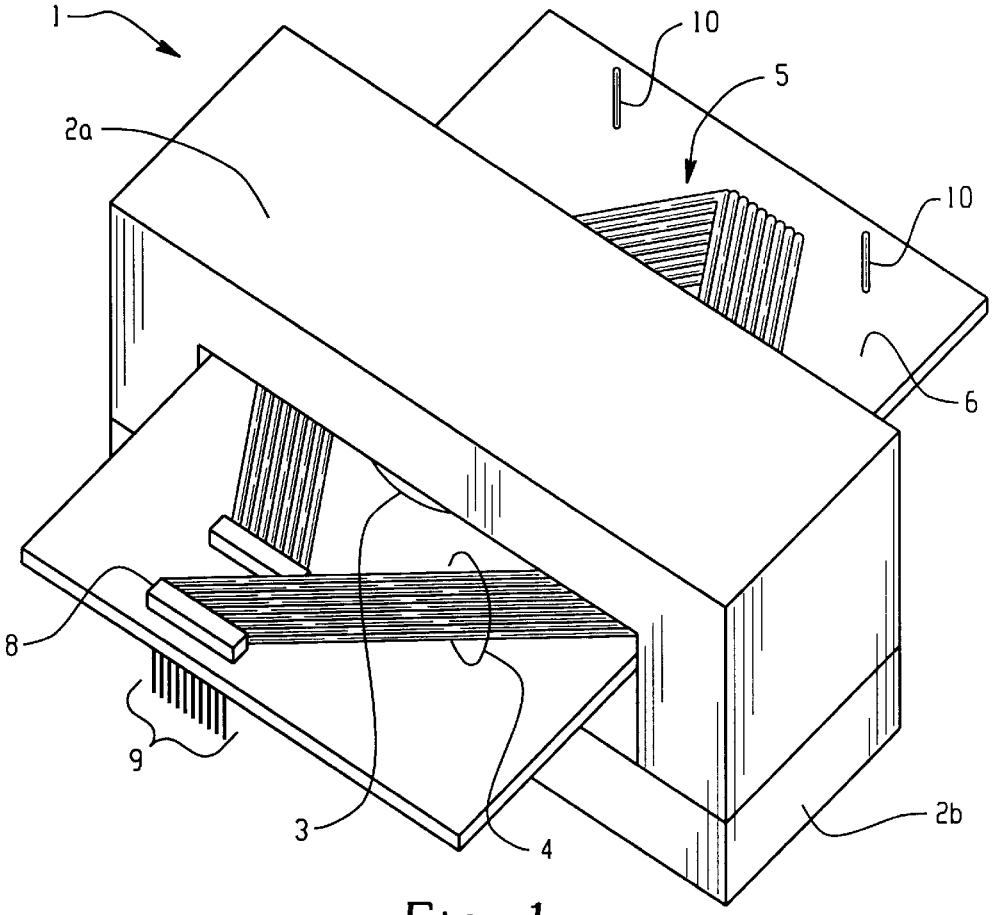
FIG. 1 is a perspective view showing a transformer according to a first embodiment of the present invention.

FIG. 1 is a perspective view showing an exterior appearance of a multi-channel uniform output type transformer (hereinafter, referred to as "transformer") according to an embodiment of the present invention as viewed from the upper part in front. The secondary winding is a flat cable belt 4 including covered conductor for the output system, and this flat cable belt 4 is wound, for a turn, round a winding shaft portion 3 of EI type cores 2*a* and 2*b* to form a flat loop member 5. This flat loop member 5 is arranged in the form of a plane on a printed circuit substrate 6 parallel to a plane orthogonal to the winding shaft portion 3 by folding the flat cable belt 4 in the same direction a plurality of number of times. In this respect, the number of turns of the secondary winding is not limited to one turn, but can be appropriately changed in accordance with the output voltage.

An end portion of the flat cable belt 4 is collectively pressed by a flat cable connector 8 fixed onto the printed circuit substrate 6, and each conductor is connected to a lead pin 9 of a connector 8. Further, the primary winding is wound round the winding shaft portion 3 on the substrate 6, and its starting end and closing end are connected to terminal pins 10 installed into the substrate 6.

According to the present embodiment, each conductor is aligned in the same sequence at an end portion of the cable belt by folding the flat cable belt 4 three times. Further, both end portions of the flat cable belt 4 are overlapped. This is normally arranged such that correspondingly to a capacitor inserted between a starting end and a closing end of each conductor in a transformer 1, the starting end and the closing end of each conductor are linearly arranged without stepping over other conductors on the substrate 6 and the capacitor can be connected without the aid of any jumper wire.

Figure 2:
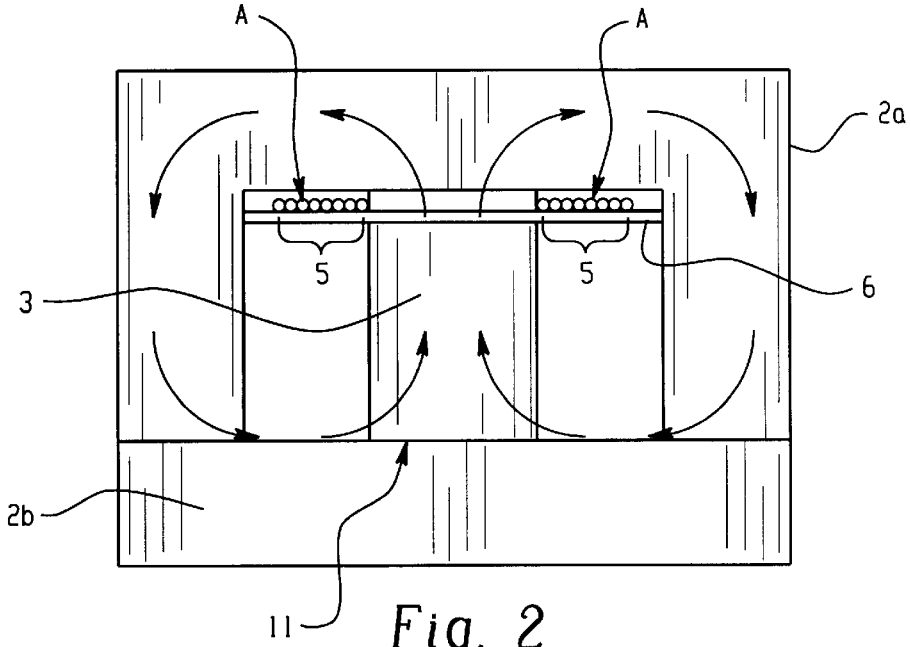
FIG. 2 is a front view for the above described first embodiment showing relationship between a flow of magnetic flux and a gap position.

FIG. 2 shows relationship between a flow of magnetic flux and a gap position according to the present embodiment as a front view for a transformer 1. In order to strike a balance between magnetic flux for interlinking each conductor, the flat loop member 5 in the winding shaft portion 3 of the cores 2*a* and 2*b* is arranged at the furthest distance from the gap 11. In this figure, it can be seen that a portion A at which each conductor of the flat cable belt 4 interlinks the magnetic flux (arrows) is the best. Of course, the arrangement position of the flat loop member 4 is appropriately changed in accordance with the use of the transformer 1 and the like.

<Method of Winding Secondary Winding>

Figure 3A:
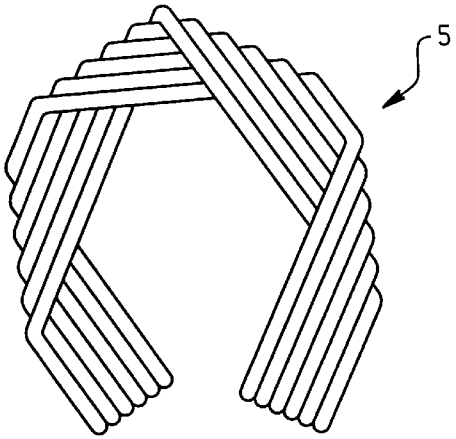
FIGS. 3A to 3D are plan views showing examples of the shape of a flat loop member according to the first embodiment, and show an example of a shape obtained by folding a flat cable belt even-numbered times, an example of a shape obtained by folding the flat cable belt odd-numbered times, an example of arrangement of a plurality of plane loop members in a concentric circle shape, and an example of placement of a plurality of plane loop members side by side by displacing them in parallel respectively.
Figure 3B:
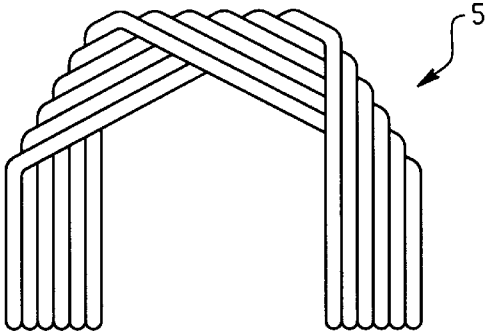
Figure 3C:
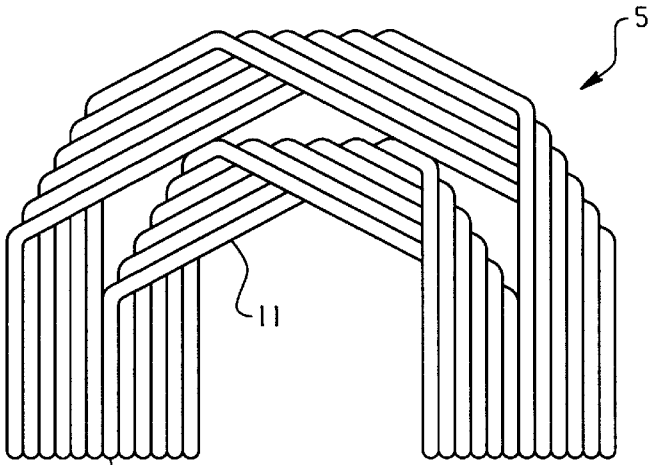
Figure 3D:
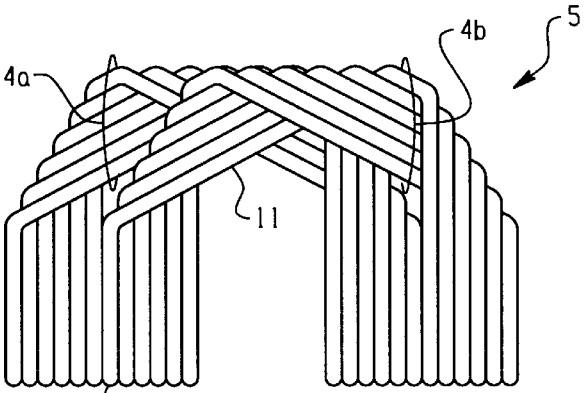

FIGS. 3A to 3C show methods of folding the flat cable belt as a plan view of the flat loop member. Each conductor of the flat cable belt can be caused to coincide in length and be made uniform in line resistance by appropriately folding the flat cable belt (A). Further, when it is folded odd-numbered times, areas obtained by interlinking each conductor of the secondary winding with magnetic flux excited by each primary winding become equal to each other and further output voltage for each area can be made uniform (B). Also, the sequence of arrangement for each conductor can be made identical between at the winding start and at the winding close as described above.

Further, there can be also supposed examples (C) and (D) in which a plurality of plane loop members are formed by individually folding a plurality of flat cable belts. (C) shows an example in which the plurality of plane loop members are arranged in a concentric circle shape, and (D) shows an example in which a plurality of plane loop members having the substantially same shape are arranged side by side by displacing each of them in parallel.

These winding methods (C) and (D) correspond to a decrease in magnitude of an induced electromotive force to be caused by a conductor portion at the center of the flat cable belt. When balanced between left and right and a maximal value for the magnetic flux density is reached within the secondary winding area, such as, when the primary winding and the secondary winding overlap at the completely same position, this phenomenon occurs. Thus, in (C) and (D), it is arranged such that even conductors which were at the center at an endpoint are caused to pass through paths inside the loop, and that a number of magnetic flux which interlinks through the paths increases or decreases with the maximal value interposed therebetween. In this respect, in case of (C), the plurality of flat cable belts may be formed by tearing an intermediate portion of one flat cable belt in the direction of the conductor, and may be formed by gathering end portions of a plurality of groups of flat cable belts. Also, if performed as shown by (D), it is possible to make length of the windings substantially identical, and if the flat cable belt is folded odd-numbered times to form a plane loop member, sequences of arrangement of the conductor at both ends can be made identical.

<Method of Packaging Elements>

Figure 4A:
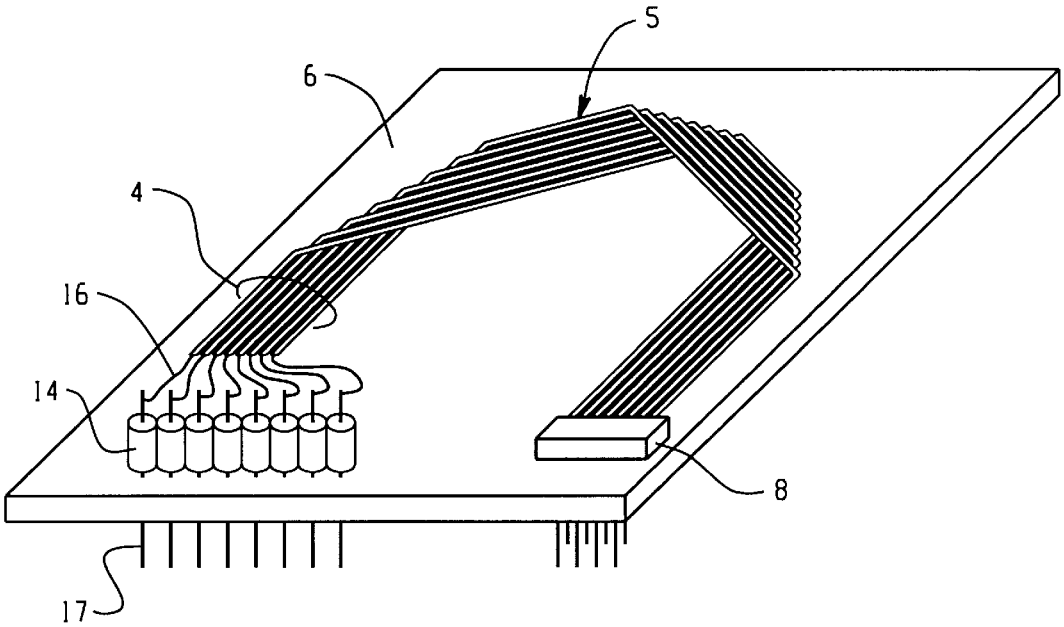
FIGS. 4A and 4B are perspective views showing a flat loop member arranged on a substrate surface as an example of packaging the diode according to the first embodiment.
Figure 4B:
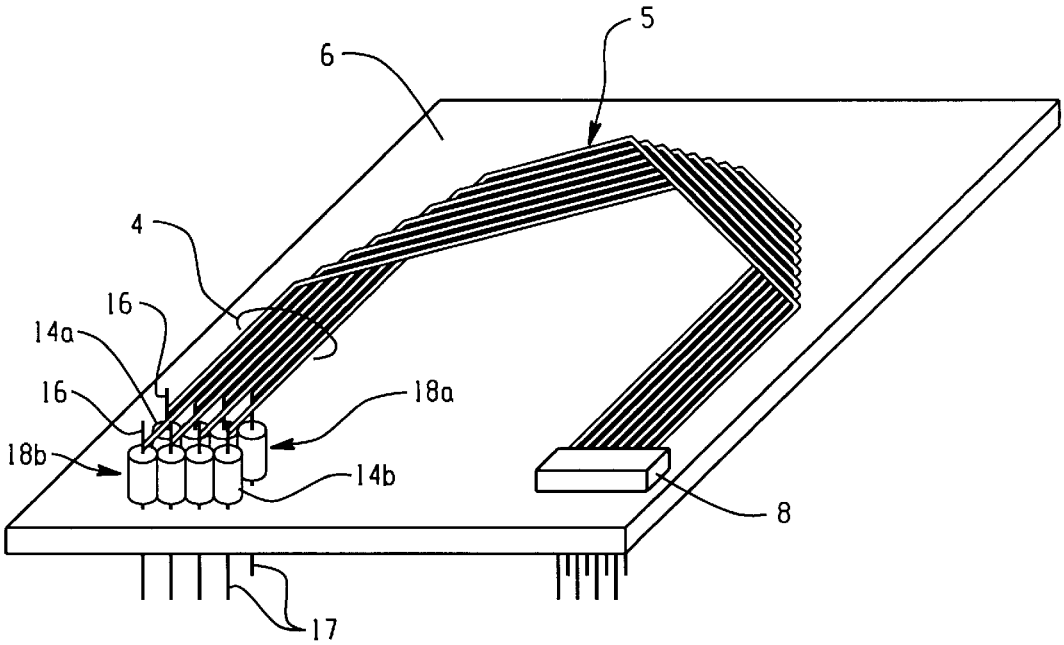
Figure 11:
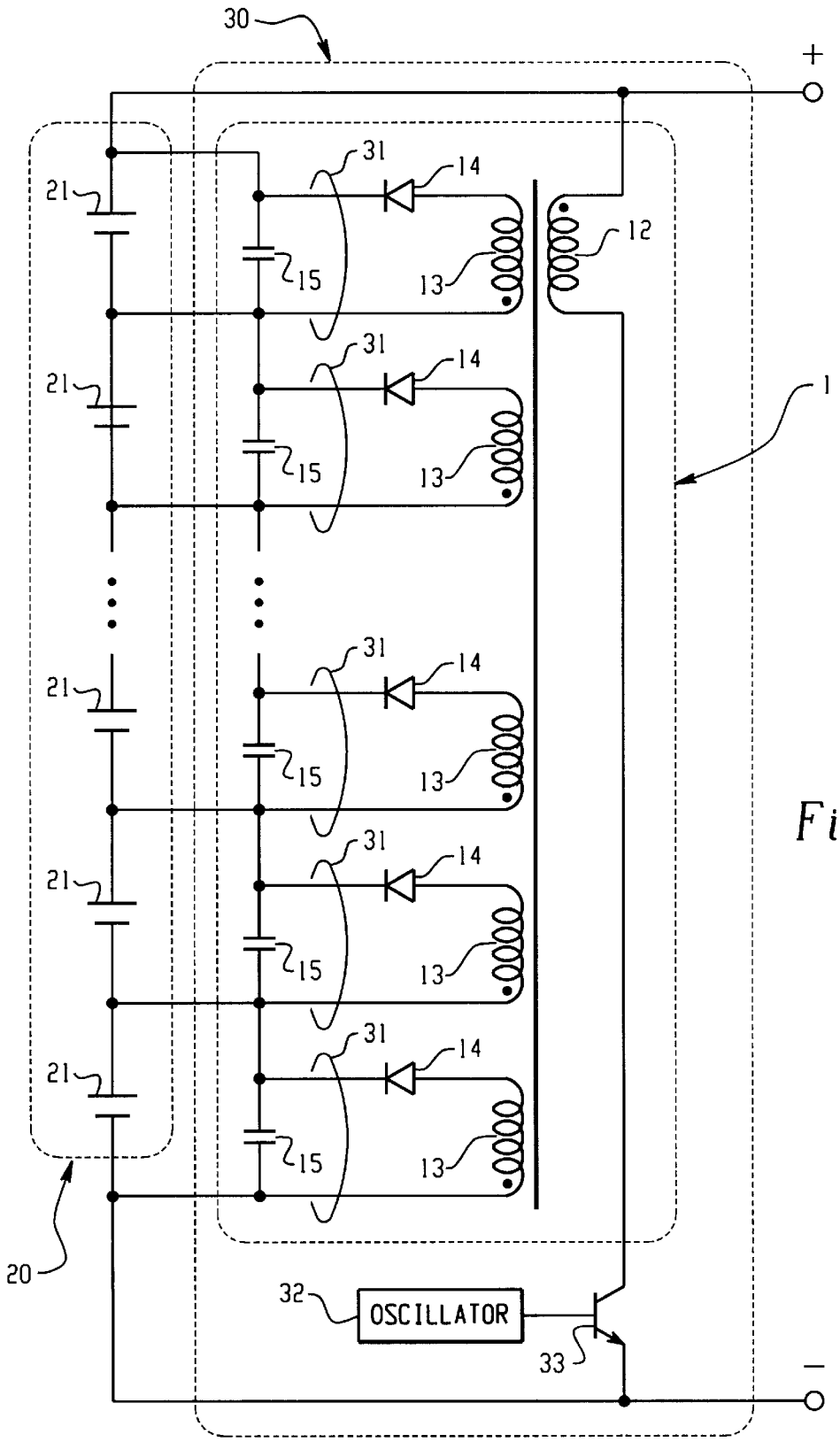
FIG. 11 is a circuit diagram when a transformer according to each embodiment described above is used to charge a series secondary battery.

As shown in the circuit diagram of FIG. 11, a transformer 1 may be constituted such that capacitors 15 and diodes 14 are connected to appropriate circuit positions in addition to the primary winding and the secondary winding. FIGS. 4A and 4B show schematic views for a method of packaging elements in a transformer 1 including diodes 14 as a perspective view for a flat loop member arranged on a substrate surface. Using axial type diodes 14, in which terminals are installed in a line on the diodes, the diodes 14 are packaged by vertically setting up on the printed circuit substrate 6 with lead pins 17 on the cathode side placed downward. Each conductor at one end portion of the flat cable belt 4 is connected to lead pins 16, on the anode side (upper side), of the diodes 14, and the cathode-side lead pins 17 are, as they are, used as output terminals for the transformer 1 (A). Also, if the number of conductors is large, when diodes 14 of a number corresponding to the number of the conductors are arranged on the substrate 6 for packaging, their packaging width becomes wider than the width of the flat cable belt 4, thus deteriorating the packaging efficiency. If, as shown in (B), two rows of diode rows (array) 18*a* and 18*b* are arranged/packaged in front and in rear in a direction that the end portions of the flat cable belt 4 extend, the end portions of the flat cable belt 4 are alternately cut long and short, and a conductor corresponding to each diode 14*b* in the rear row 18*b* is guided and admitted between each diode 14*a* in the diode row 18*a* in the front row, effective packaging will be obtained.

Second Embodiment (Sheet Coil Type)

<General Structure of Transformer>

Figure 5A:
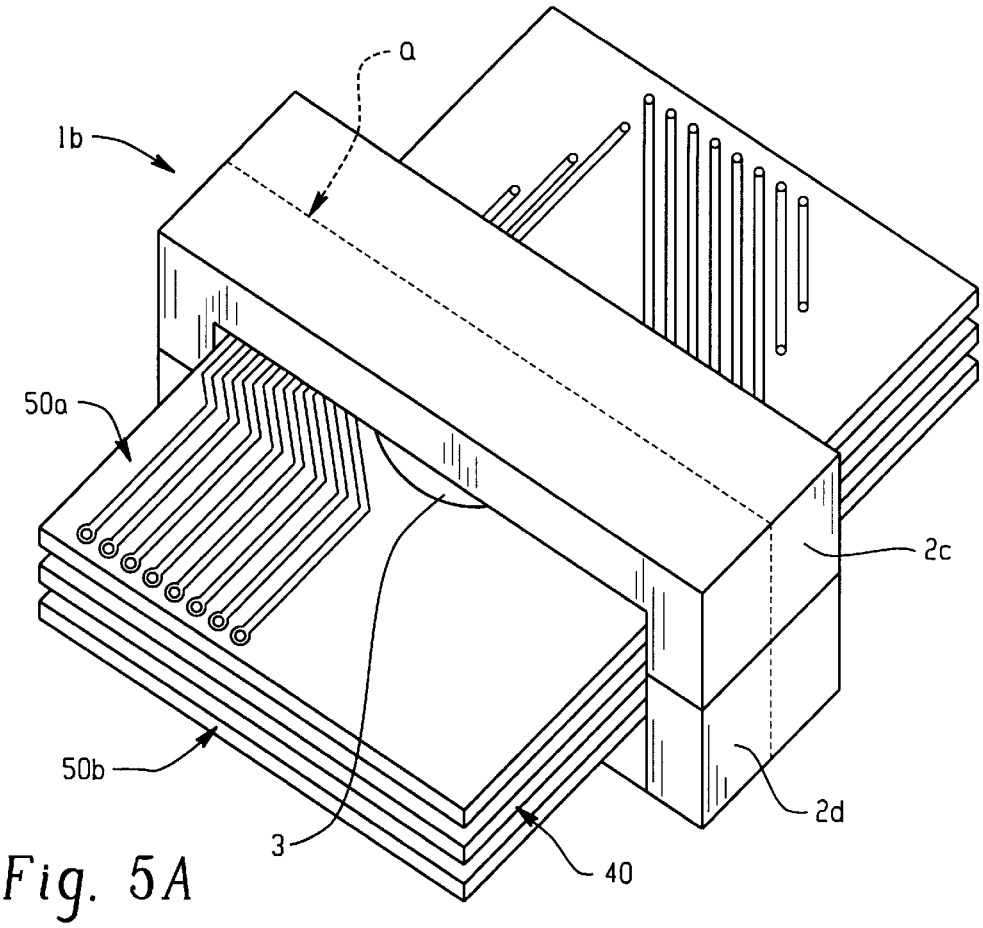
FIGS. 5A and 5B are schematic structural views showing a transformer according to a second embodiment of the present invention.
Figure 5B:
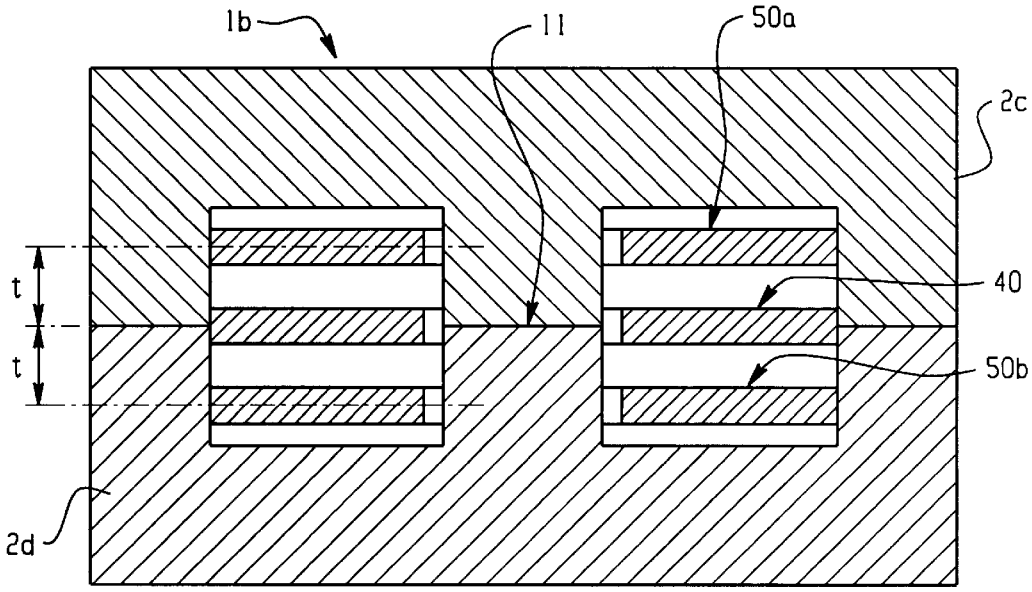

FIGS. 5A and 5B are schematic structural views showing a multi-channel uniform output type transformer 1*b* using a sheet coil according to a second embodiment of the present invention. FIG. 5A is a perspective view showing an external appearance of this transformer 1*b* as viewed from the upper part in front, and FIG. 5B is a sectional view taken on an alternate long and short dash line a in FIG. 5A as viewed from the front.

This transformer 1*b* is a sheet coil comprising a coil formed by a printed circuit in which both a primary winding and a secondary winding are formed on a substrate, and is constituted by substantially orthogonally intersecting each sheet coil with the core winding shaft to stack and arrange. In the example shown, one each of secondary sheet coils 50*a* and 50*b* is stacked above and below one primary sheet coil 40, and each of the sheet coils 40, 50*a* and 50*b* is caused to substantially orthogonally intersect with the winding shaft portion 3 of the EE type cores 2*c* and 2*d* for arranging. In this manner, in contrast to a multi-channel uniform output type transformer using one each of the primary and secondary sheet coils, an output system having twice the capacity can be provided while having the same planar area of the coil.

As regards positional relationship of each sheet coil, distances between the primary sheet coil 40 and each of the secondary sheet coils 50*a* and 50*b* are the same t. The position of the primary sheet coil 40 is caused to coincide with the position 11 of the core gap, whereby magnetic flux caused by the primary sheet coil 40 uniformly penetrates the substrate surfaces of the two secondary sheet coils 50*a* and 50*b*.

<Structure of Sheet Coil>

Figure 6A:
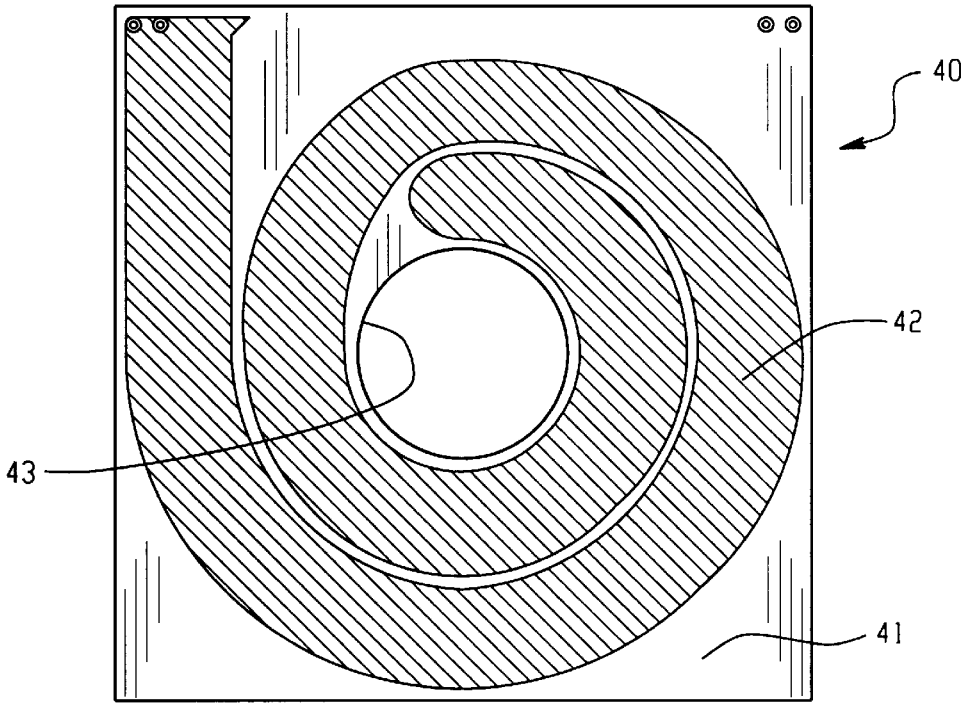
FIGS. 6A to 6D are schematic structural views showing a sheet coil according to the second embodiment.
Figure 6D:
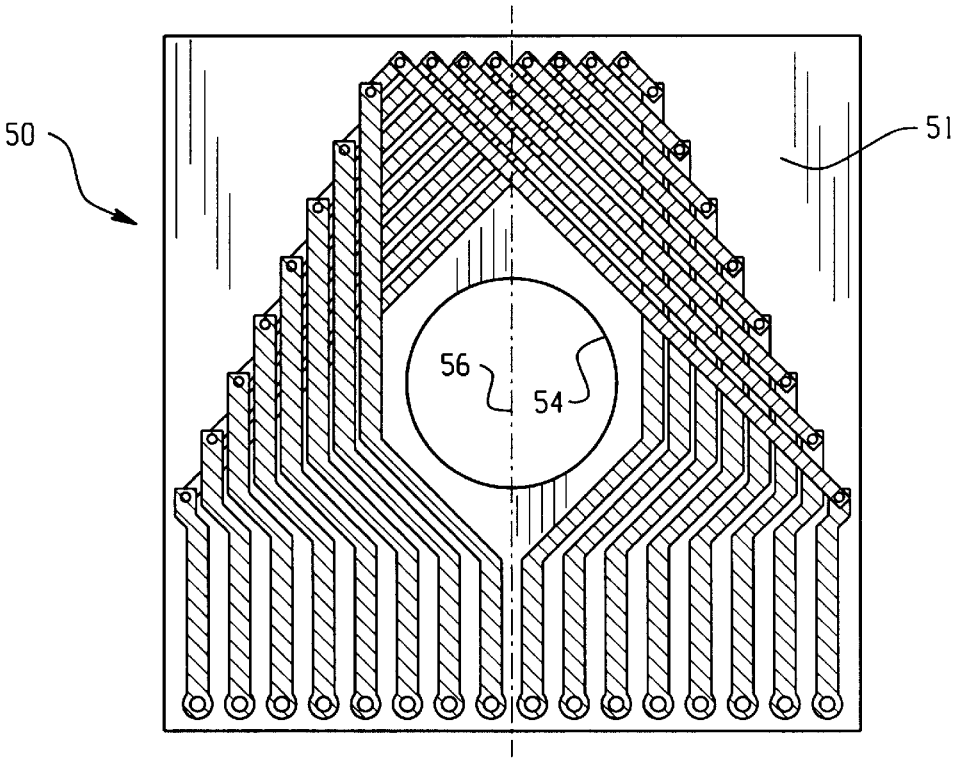
Figure 6C:
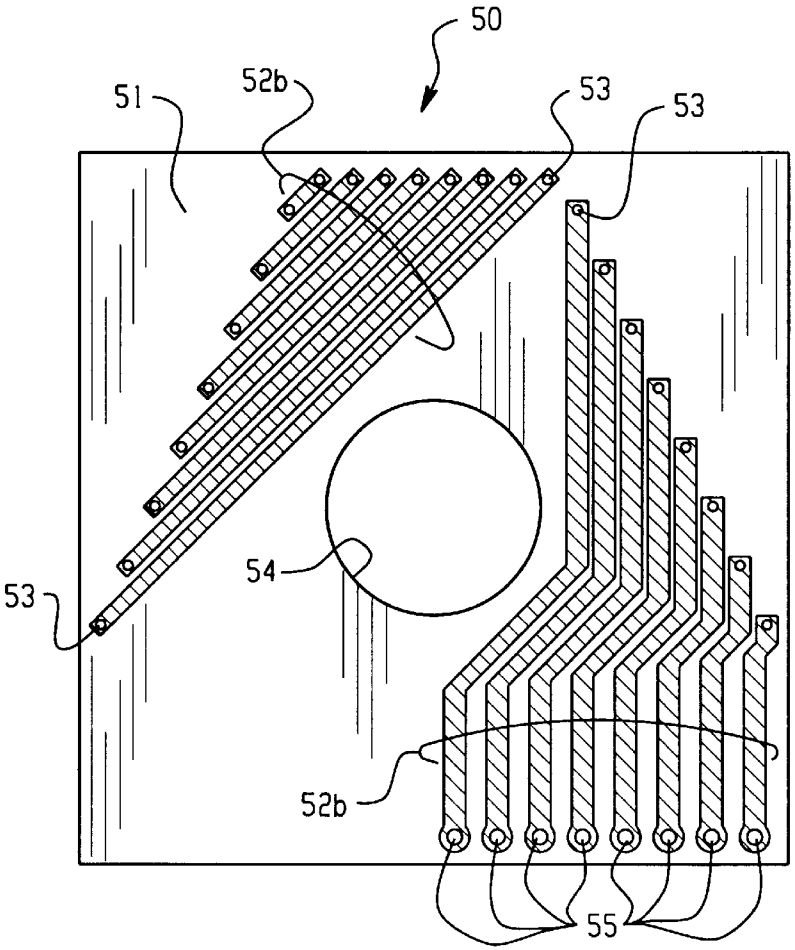
Figure 6B:
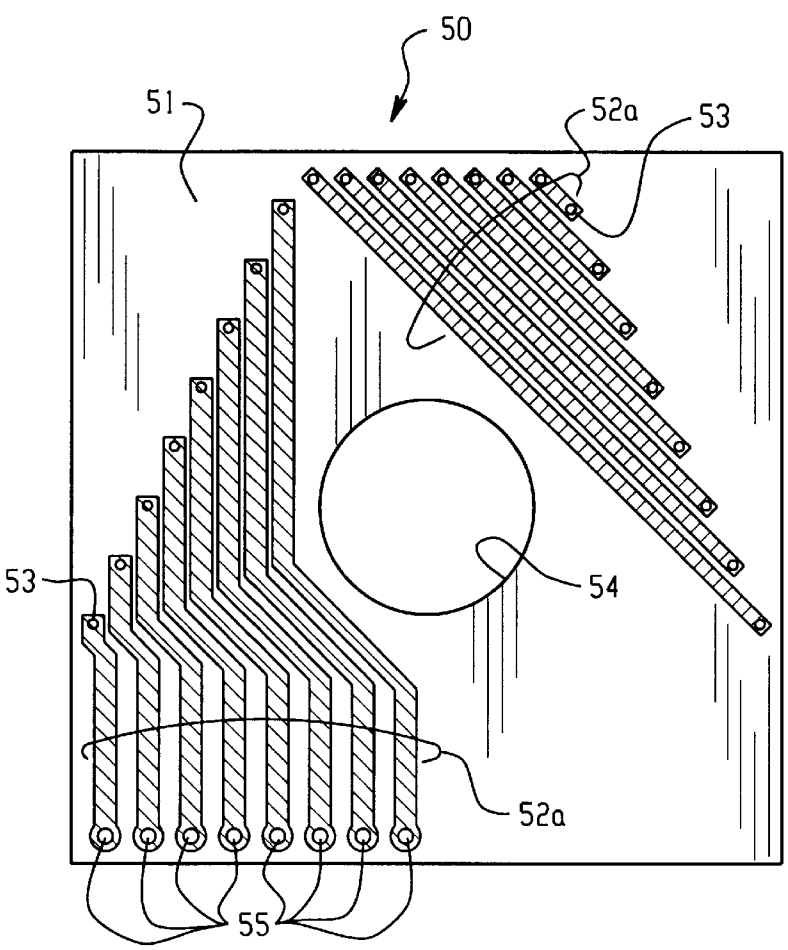

FIGS. 6A to 6D are schematic structural views showing. an embodiment of the sheet coil in a multi-channel uniform output type transformer using the above described sheet coil. FIG. 6A shows a pattern of a printed circuit on a sheet coil (primary sheet coil) 40 in the primary winding. FIG. 6B is a plan view showing a pattern of a printed circuit on a sheet coil (secondary sheet coil) 50 of a secondary winding as viewed from the surface of a substrate 51. FIG. 6C shows a pattern of a printed circuit on the back surface of the substrate 51 on the secondary sheet coil 50 as a perspective view through the surface of the substrate 51. FIG. 6D is a view obtained by superposing FIG. 6B on FIG. C, and shows patterns of the printed circuits 52*a* and 52*b* on both sides of the substrate 51 of the secondary sheet coil 50.

The primary sheet coil 40 comprises a helical printed circuit 42 formed on the surface of the substrate 41, and has an aperture 43, through which the winding shaft of the core penetrates, at the center of the substrate 41. The sheet coil (secondary sheet coil) 50 of the secondary winding comprises a plurality of printed circuits 52*a* and 52*b* formed by arranging substantially in parallel on both the front and back surfaces of the substrate 51 connected via a throughhole 53 for each output system of the transformer. In this respect, the substrate 51 has similarly an aperture 54, through which the winding shaft of the core penetrates.

The printed circuits 52*a* and 52*b* on the secondary sheet coil 50 are formed such that their patterns are alternately folded back on the front and back surfaces of the substrate. In these figures, the printed circuits 52*a* and 52*b* are folded back at three places, which corresponds to three times of folding in the above described plane loop member. Also, a portion corresponding to the winding start or the winding close of each coil on the printed circuits 52*a* and 52*b* is formed with donut-shaped pattern portions (terminal portions) 55 to be connected to an external circuit.

In the present embodiment, the patterns of the printed circuits 52*a* and 52*b* are line-symmetrical with respect to a line 56 for passing through a center (actually, winding shaft of the coil) of the aperture 54, into which the core winding shaft portion is inserted. This is performed in order to interlink the printed circuits 52*a* and 52*b* corresponding to each output system with the magnetic flux on both sides of the centerline 56 in good balance.

In this respect, in the transformer 1*b* shown in FIG. 5, if wiring patterns (actually, patterns of wired portions with which the magnetic flux interlinks) of the upper and lower secondary sheet coils 50*a* and 50*b* are caused to be plane-symmetrical with respect to the substrate surface of the primary sheet coil, the printed circuit of each output system will uniformly interlink with the magnetic flux.

Figure 7A:
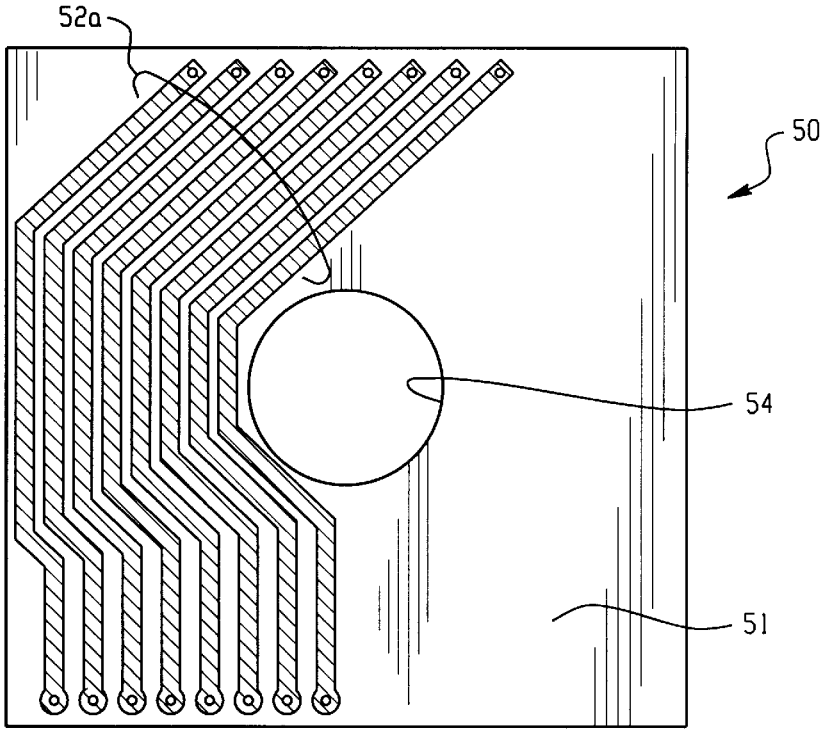
FIGS. 7A and 7B are printed circuit views showing a modification example of the above described secondary sheet coil.
Figure 7B:
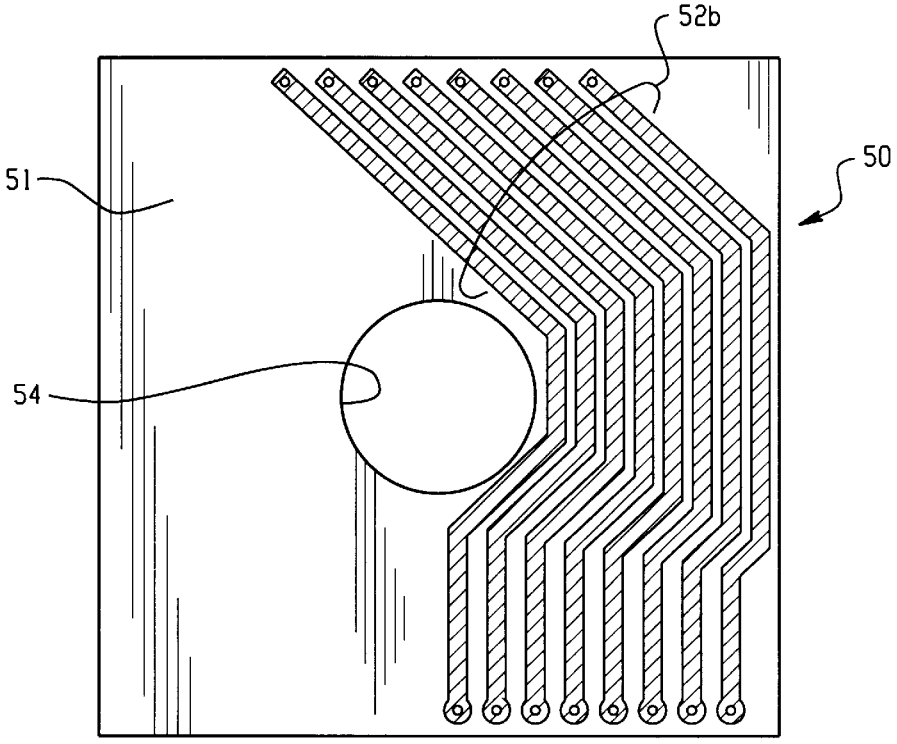

FIGS. 7A and 7B show an example of a secondary sheet coil obtained by folding once: a pattern (A) of a printed circuit 52*a* on the surface of the substrate 51; and a pattern (perspective view B through the surface of the substrate) of a printed circuit 52*b* on the back surface of the substrate 51 respectively.

<Positional Adjustment and Fixing of Sheet Coil>

Figure 8A:
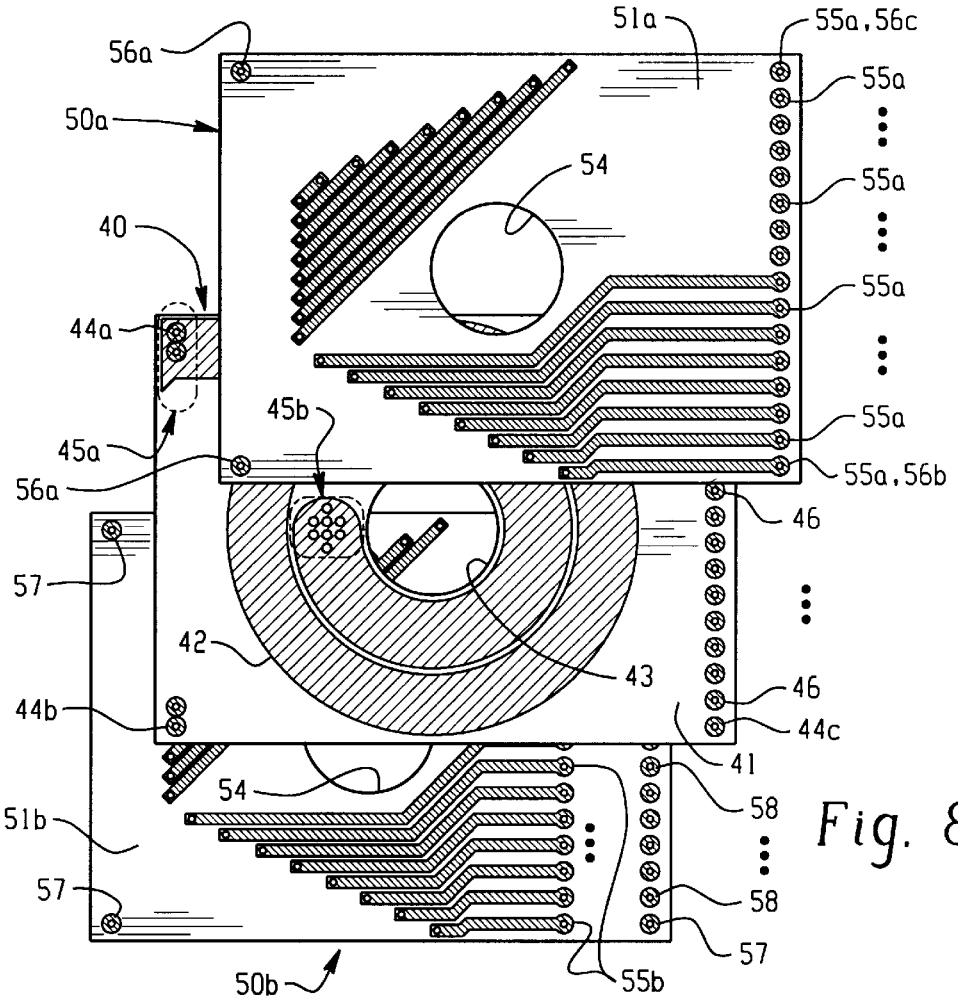
FIGS. 8A and 8B are schematic structural views for concretely showing a method of fixing a sheet coil according to the second embodiment.
Figure 8B:
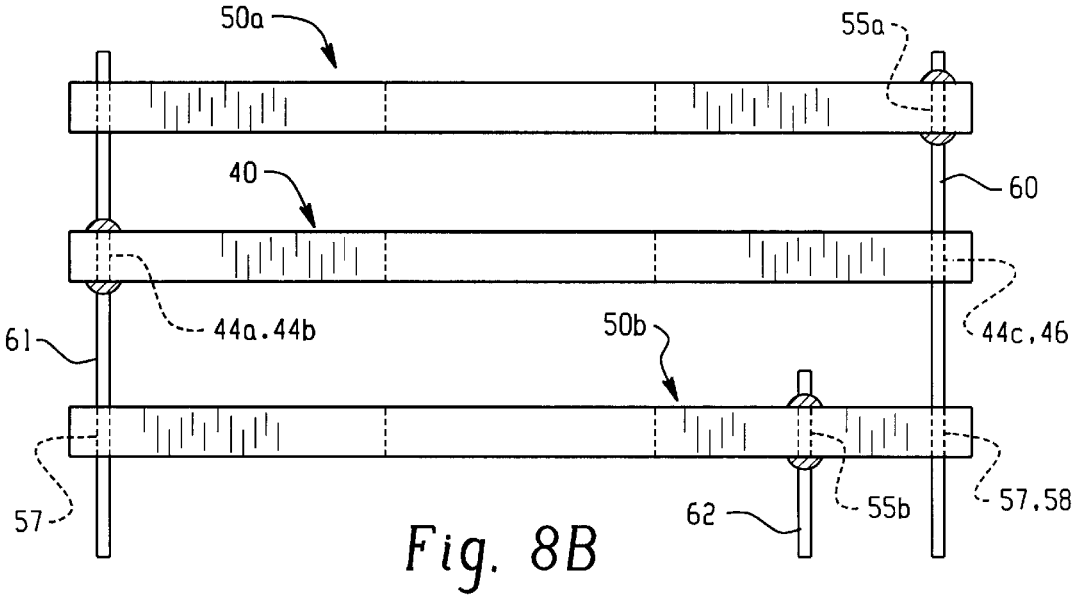

FIGS. 8A and 8B show an embodiment for precisely adjusting and fixing the sheet coils 40, 50*a* and 50*b* in the transformer 1*b* shown in FIG. 5, in a predetermined positional relationship. At the central portions of the substrates 41, 51*a* and 51*b* of each sheet coil 40, 50*a* and 50*b*, there are formed positioning holes at appropriate positions in addition to holes 43 and 54, into which the core winding shaft portion is inserted. FIG. 8A shows plan views for each sheet coil to be stacked one another, and FIG. 8B shows a side view for a stacked state of each sheet coil.

At four corners of the substrate 51*a* of the secondary sheet coil 50*a* arranged on the top layer of the primary sheet coil 40, positioning holes 56*a* to 56*c* are formed respectively. Of these positioning holes 56*a* to 56*c* at the four corners, the positioning hole 56*b* serves dually as a terminal portion 55*a* of the printed circuit formed on the surface of the substrate 51*a*. Also, the positioning hole 56*c* serves dually as the terminal portion 55*a* formed on the back surface of the substrate 51*a*. On the terminal portion 55*a* (including positioning holes 56*b* and 56*c*), a lead pin 60 is installed, and on the positioning hole 56*a*, a lead pin 61 is installed. In this respect, the lead pin 61 is insulated from the printed circuit formed on the substrate 51*a*.

At four corners of the substrate 41 of the primary sheet coil 40, there are formed positioning holes 44*a* to 44*c*. Among these positioning holes 44*a* to 44*c*, there are positioning holes 44*a* and 44*b* electrically connected to terminal portions 45*a* and 45*b* of the winding start and winding close of the coil. At an external closing end 45*a* of a helical printed circuit 42, the positioning hole 44*a* is formed and is electrically connected to the printed circuit 42. The internal closing end 45*b* is connected to the predetermined positioning hole 44*b* through a printed circuit disposed on the back surface of the substrate 41. The lead pin 61 is inserted through at the positions of the positioning holes 44*a* and 44*b*, and is electrically connected to the terminal portions 45*a* and 45*b*.

Further, in this primary sheet coil 40, there is also formed, at the position of the substrate, which overlaps the terminal portion 55*a* of the secondary sheet coil 50*a* to be stacked on top of the primary sheet coil 40, a throughhole 46 for the lead pin 60 to be installed on the secondary sheet coil 50*a*. In this example, the lead pin 60 is inserted through the throughhole 46 and the positioning hole 44*c*. In this respect, the lead pin 60 is electrically insulated from the holes 44*c* and 46, through which the lead pin 60 penetrates.

At four corners of the substrate 51*b* of the secondary sheet coil 50*b* in the lower layer, there are formed positioning holes 57. As in the case of the primary sheet coil, there is formed, at the position of the substrate, which overlaps the terminal portion 55*a* of the secondary sheet coil 50*a* in the upper layer, a throughhole 58 for the lead pin 60 of the secondary sheet coil in the upper layer. This throughhole 58 is also insulated from the lead pin 60. In this respect, at the terminal portion 55*b* of the sheet coil 50*b,* the lead pin 62 is electrically connected and installed.

A lead pin installed on a certain sheet coil is inserted through an appropriate positioning hole of another sheet coil, and after the distance between substrates is adjusted, the lead pin and the sheet coil are appropriately fixed by adhesion or the like. Thus, each of the lead pins 60 to 62 functions as a guide pin for adjusting the distance between the sheet coils, and also functions as a terminal for connecting a predetermined printed circuit of a predetermined sheet coil to a predetermined external circuit.

<Packaging of Elements>

Figure 9B:
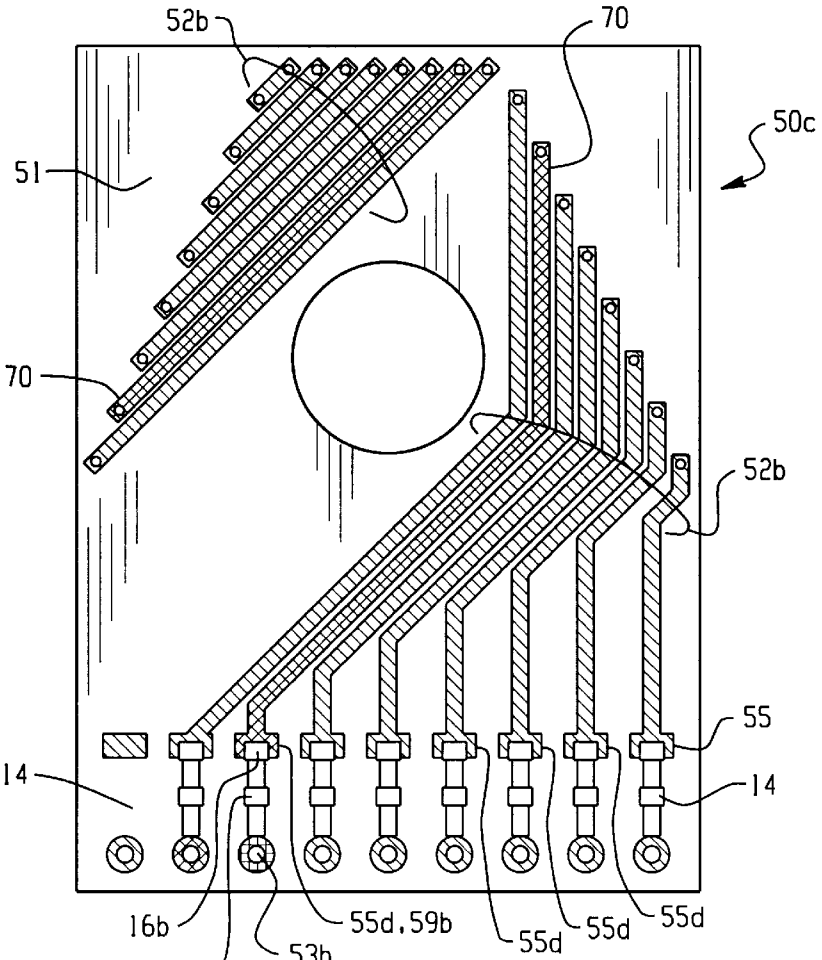
FIGS. 9A and 9B are schematic structural views showing a diode-equipped secondary sheet coil according to the second embodiment.
Figure 9A:
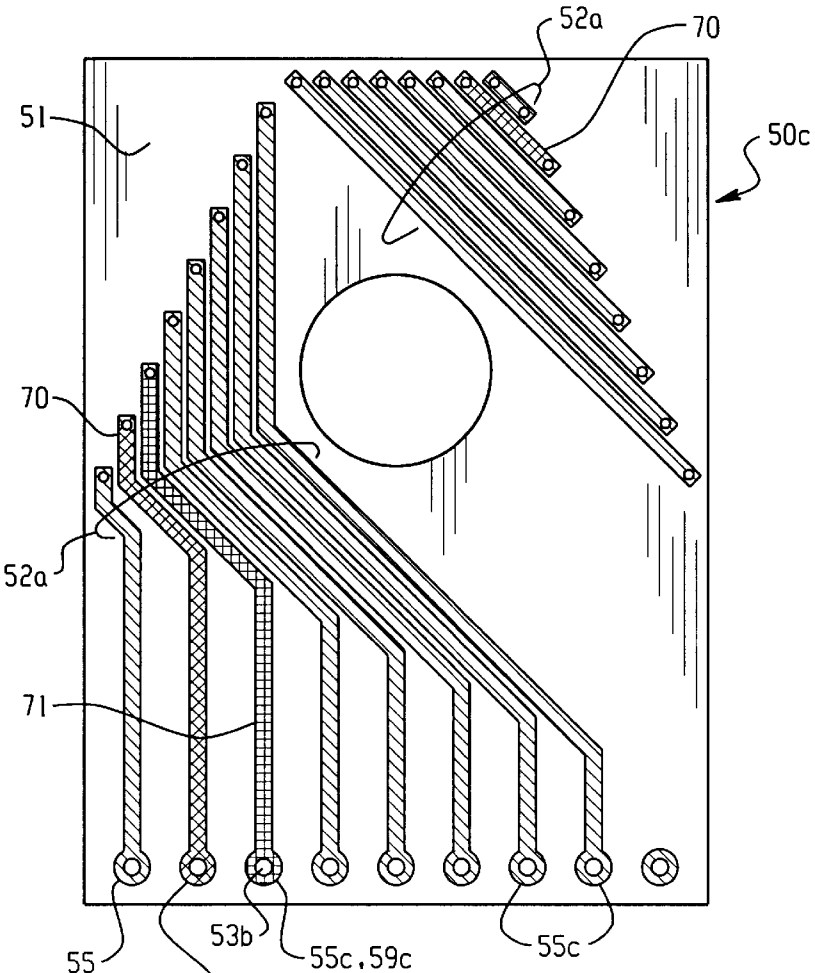

FIGS. 9A and 9B show embodiments for diode-equipped secondary sheet coils: a plan view for a printed circuit pattern on the front and back surfaces of the substrate 51; and a perspective view for a printed circuit pattern on the back surface of the substrate 51 through the substrate surface respectively. This secondary sheet coil 50*c* is formed by folding the pattern three times such that terminal portions 55*c* and 55*d* of the coil are separated on the front and back surfaces of the substrate 51 respectively for being formed. To the terminal portion 55*c* of each output system on the back surface of the substrate 51, one lead terminal (cathode or anode) 16*b* of a plane packaging type diode 14 is connected.

When focusing attention to positional relationship between a printed circuit formed on one surface and a printed circuit formed on the other surface, it can be seen that a portion of the printed circuits is overlapped between the front and back surfaces of the substrate 51. More specifically, the terminal portion 55*d* of the printed circuit portion 52*b* on the back surface overlaps the printed circuit 52*a* on the surface of the substrate 51. When further focusing attention to a terminal portion 59*a* of a certain output system on the surface of the substrate 51, another terminal portion 59*b* on the back surface connected to the terminal portion 59*a* through a printed circuit 70 overlaps the position of a printed circuit 71 of an adjacent output system on the front and back surfaces of the substrate. To the terminal portion 59*b* on the back surface of the substrate 51 of the printed circuit 70, one lead terminal 16*b* of the plane-packaging type diode 14 is connected, and the other lead terminal 17*b* is connected to the terminal portion 59*c* of the printed circuit 71 on the surface via a throughhole 53*b*. By the adoption of such printed circuit structure, where the circuit shown in FIG. 11 is constituted, the diode 14 to be inserted between the winding start portion and the winding close portion of the winding of an adjacent output system can be directly connected together on the substrate of the secondary sheet coil 50*c*.

In this respect, it is not necessary for the terminal portion of a certain output system to overlap the printed circuit of the adjacent system on the front and back surfaces of the substrate, but one lead terminal of the diode can be connected to the lead terminal portion on the surface of the substrate while the other lead terminal portion can be connected to a predetermined lead wiring portion on the back surface of the substrate via the throughhole.

<Multi-Layer Substrate Type Sheet Coil>

Figure 10:
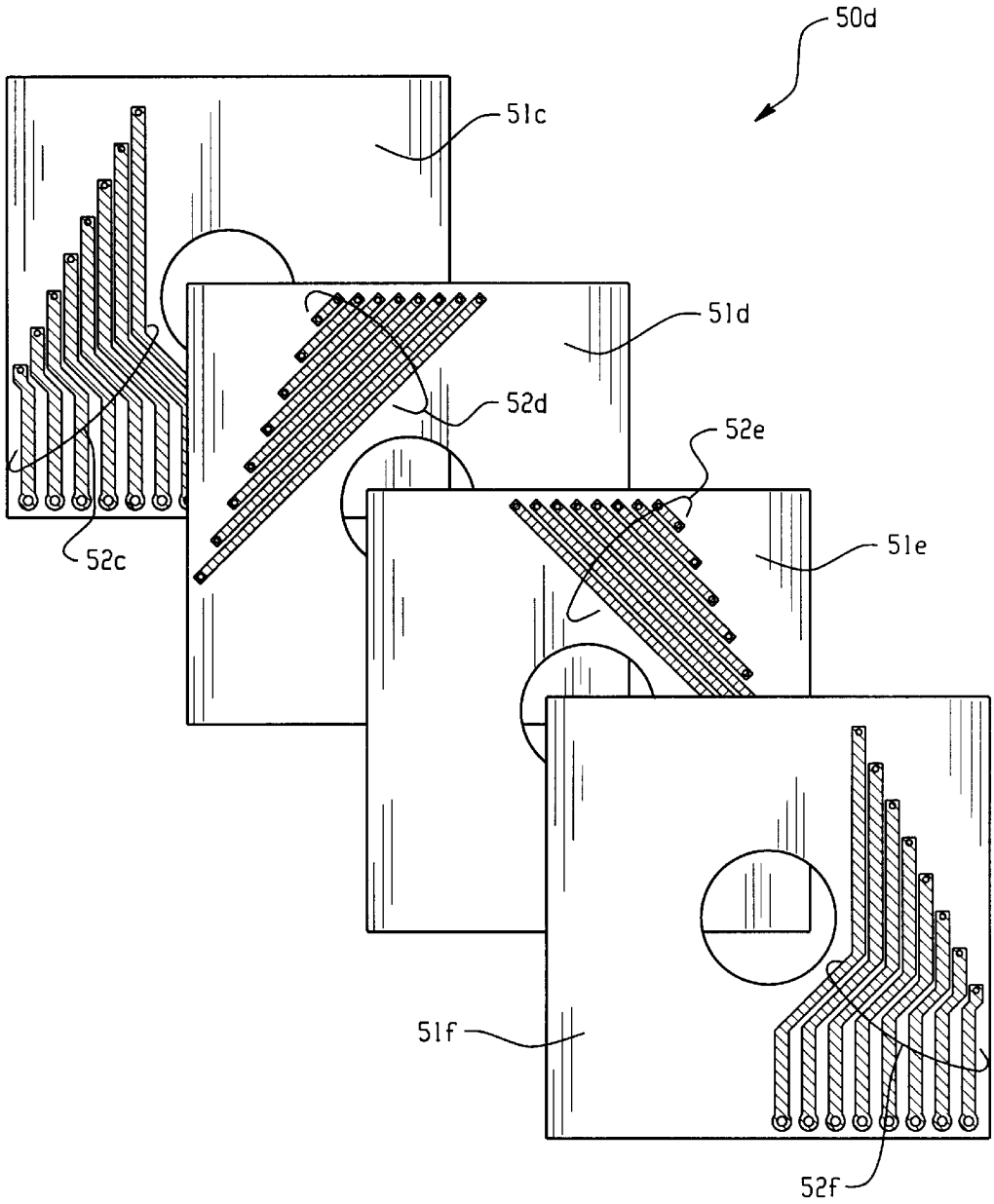
FIG. 10 shows exploded views for each layer of a printed circuit pattern of a secondary sheet coil using a multi-layer substrate, which is a modification example for the second embodiment.

As the secondary sheet coil, a type, in which a multi-layer substrate is used, can also be conceived in addition to the above described type using both surfaces of the substrate. More specifically, the secondary sheet coil is formed by stacking a plurality of substrates to form a printed circuit on the surfaces of substrates of each layer respectively and connecting the printed circuits between each layer via a throughhole. FIG. 10 shows an example of a secondary sheet coil using a multi-layer substrate of four layers, as a view exploded for each layer. This secondary sheet coil 50*d* is a secondary sheet coil obtained by folding three times, and printed circuits 52*c* to 52*f* formed on each of four layers of substrates 51*c* to 51*f* are formed so as to sequentially become folded patterns toward the lower layer. In this respect, in such stacked substrate type secondary sheet coil, the number of turns of the coil can be set to two or more turns because the upper substrate is insulated from the lower substrate. Of course, the printed circuit can also be formed on both sides of a substrate of each layer.

Further, a transformer may be constituted by individually stacking one primary sheet coil and secondary sheet coils using a multi-layer substrate on the winding shaft of a core for arranging, and primary and secondary sheet coils may be all integrally formed into a multi-layer substrate.

Performance of Transformer According to the Present Invention

The performance of the multi-channel uniform output type transformer according to the present invention is evaluated as a variation in output voltage from each channel to input voltage, and the results are summarized in the following Table 1 and Table 2.

Tables 1 and 2 show performance evaluation when voltage of 50.4V is inputted into a transformer having a number of output channels of 12, and when voltage of 25V is inputted into a transformer having a number of output channels of 16 respectively. In this respect, samples A to C in the Tables indicate a transformer (conventional example: Sample A) obtained by winding round the core in a concentric circle shape without folding back the flat cable, a transformer (first embodiment 1 according to the present invention: Sample B) using a plane loop member obtained by folding the flat cable three times, and a transformer (a second embodiment according to the present invention: Sample C) using secondary sheet coils obtained by folding once respectively.

[Table 1]

TABLE 1

| Output channel | Sample A | Sample B | Sample C |
|---|---|---|---|
| CH1 | 4.230 | 4.185 | 4.185 |
| CH2 | 4.216 | 4.158 | 4.203 |
| CH3 | 4.208 | 4.164 | 4.204 |
| CH4 | 4.235 | 4.172 | 4.206 |
| CH5 | 4.224 | 4.190 | 4.209 |
| CH6 | 4.206 | 4.189 | 4.213 |
| CH7 | 4.145 | 4.200 | 4.210 |
| CH8 | 4.115 | 4.213 | 4.189 |
| CH9 | 4.186 | 4.230 | 4.193 |
| CH10 | 4.166 | 4.196 | 4.201 |
| CH11 | 4.212 | 4.200 | 4.214 |
| CH12 | 4.258 | 4.226 | 4.208 |
| Average | 4.200 | 4.194 | 4.203 |
| Standard Deviation | 0.041 | 0.022 | 0.009 |
| Maximum value–Minimum Value | 0.143 | 0.072 | 0.029 |

TABLE 2

| Output channel | Sample A | Sample B | Sample C |
|---|---|---|---|
| CH1 | 1.586 | 1.559 | 1.546 |
| CH2 | 1.571 | 1.545 | 1.557 |
| CH3 | 1.584 | 1.561 | 1.561 |
| CH4 | 1.555 | 1.561 | 1.563 |
| CH5 | 1.561 | 1.550 | 1.568 |
| CH6 | 1.526 | 1.550 | 1.566 |
| CH7 | 1.566 | 1.573 | 1.563 |
| CH8 | 1.520 | 1.562 | 1.557 |
| CH9 | 1.516 | 1.565 | 1.556 |
| CH10 | 1.551 | 1.563 | 1.561 |
| CH11 | 1.538 | 1.567 | 1.568 |
| CH12 | 1.570 | 1.565 | 1.568 |
| CH13 | 1.551 | 1.564 | 1.568 |
| CH14 | 1.582 | 1.561 | 1.569 |
| CH15 | 1.588 | 1.564 | 1.569 |
| CH16 | 1.614 | 1.587 | 1.557 |
| Average | 1.561 | 1.562 | 1.562 |
| Standard Deviation | 0.027 | 0.010 | 0.006 |
| Maximum value–Minimum Value | 0.098 | 0.042 | 0.023 |

From the Tables 1 and 2, it can be seen that a transformer according to the present invention has fewer variations in output voltage between each channel than the conventional transformer.

[Effect of the Invention]

The multi-channel uniform output type transformer according to the present invention has a secondary winding obtained by winding round the core while the flat cable belt is being folded. For the reason, the winding process of conductors can be simplified even if the number of output channels is high, and both ends of each conductor can be easily identified. Therefore, the manufacturing cost of the transformer can be reduced.

By folding the flat cable belt, the length of each conductor becomes constant and the line resistance of each conductor can be made identical. As a result, it becomes possible to restrain variations in output voltage in each channel. Further, by folding the flat cable belt odd-numbered times, each conductor becomes also identical in area which interlinks with the magnetic flux, and the output voltage can be made more uniform.

When the flat cable belt is folded odd-numbered times, each conductor becomes identical in the arrangement of conductors at both ends of the flat cable belt. Therefore, the conductors can be further easily identified. If both ends of the flat cable belt are overlapped, it will become possible to insert a capacitor between each conductor without using any jumper wire, and the packaging process of the capacitor will be simplified. This also contributes to reduced cost.

If a plurality of flat cable belts are individually folded to form a plurality of flat loop members and each loop member is arranged in a concentric circle shape, a conductor, which is an end portion of the flat cable belt and arranged at the center, will also be able to pass through an internal path of the flat cable belt halfway through the winding operation. For the reason, they are capable of coping with a case where the number of interlinkage magnetic flux reaches its peak value at the central portion of the flat cable belt, and decreases on its both sides. If a plurality of plane loop members are used and each plane loop member is displaced in parallel to one another and is arranged by side by in parallel, it is possible to cope with the above described problem concerning the number of interlinkage magnetic flux, and to make the length of each conductor substantially constant. When the flat cable belt is formed by folding odd-numbered times, it is also possible to make the arrangement order identical at both ends (winding start and winding close) of the conductor.

If the flat loop member is arranged at the farthest distance from the gap at the core winding shaft portion, it will be possible to interlink with the magnetic flux in good balance on both sides of each conductor of the secondary winding, and to make the output characteristic of each channel uniform.

A commercial collectively pressure welding type flat cable connector can be applied to an end portion. The use of the connector enables connection between an output path of the transformer and an external circuit to be made easier, and a connected state of each conductor to be made uniform. Therefore, the manufacturing cost can be reduced, the reliability is improved, and the characteristic of each channel also becomes uniform.

If, when an diode is connected to each conductor, an axial type diode is used, then the lead pin of the diode can be used as it is, as an output terminal of the transformer. If, when the number of channels is high, then diodes are divided into a plurality of rows for packaging, the width at which the diodes are packaged can be made narrower, contributing to the miniaturization of the transformer.

If a substrate equipped with connectors and various elements is used as a printed circuit substrate and a flat loop member is also arranged on this substrate surface, the secondary winding will be easily fixed onto its orthogonal plane at a predetermined position on the core winding shaft portion. Also, each element will be easily packaged. Further, it will be possible to receive the primary winding on the substrate and to install its terminal on the printed circuit substrate.

If a sheet coil is used for the coil winding, it will be possible to precisely form the primary and secondary windings in shape of wiring, and to correctly adjust the arrangement relationship to the core and the positional relationship between windings. For the reason, the output voltage can be further made uniform.

In case of this sheet coil, each output system can be easily identified by folding odd-numbered times as in the case of the flat cable belt.

By stacking one each of the secondary sheet coil above and below one primary sheet coil, the number of output channels can be doubled without making the substrate area larger. At this time, there can be adopted various conditions for causing the printed circuit of each winding in two secondary sheet coils to uniformly interlink with the magnetic flux such as arranging the primary sheet coil at the core gap position, making the distances identical between the primary sheet coil and each secondary sheet coil, and further making the pattern of the printed circuit on the secondary sheet coil plane-symmetrical with respect to the primary sheet coil. Of course, the voltage at each output channel can be made very uniform by appropriately combining these conditions.

By making the most of the primary and secondary windings as a sheet coil, it is possible to cause a lead pin connected to the printed circuit of a certain substrate to pass through another substrate for using the lead pin as a guide pin for precisely adjusting a distance between substrates and arrangement position to the core, or to package a plane-packaging type diode onto one surface of the substrate. If the position of a terminal portion of a printed circuit is appropriately adjusted on the front and back surfaces of the substrate or between substrates of a multi-layer substrate, it becomes possible to connect one lead terminal of the diode to the terminal of a certain output channel and to directly connect the other lead terminal to the terminal of the adjacent output channel. Thus, there is no need for guiding through any jumper pins or wiring, reducing the manufacturing cost relating to the packaging and contributing to miniaturization of the transformer.

What is claimed is:

1. A multi-channel uniform output type transformer, comprising a primary winding and a secondary winding wound round a winding shaft portion of a core, for outputting uniformly balanced voltage from each of multiple output channels, wherein:

said secondary winding is a flat cable belt covered with an insulating film and comprises a plurality of parallel conductors of the same number as said output channels;

a plane loop is formed on a printed circuit substrate by folding said flat cable belt more than two times in such a manner that one flat surface of said flat cable is reversed upon the other flat surface by each folding; and said plane loop is substantially orthogonally placed about said winding shaft of said core.

2. A multi-channel uniform output type transformer according to claim 1, wherein said plane loop is formed by folding said flat cable belt odd-numbered times.

3. A multi-channel uniform output type transformer according to claim 2, wherein said plane loop is formed such that one end of said flat cable belt is adjacent to other end of said flat cable belt.

4. A multi-channel uniform output type transformer according to claim 1 or 2 wherein a plurality of said plane loop is formed on said printed circuit substrate, and each of said plane loops is formed by each of said flat cable belts and arranged so as to become substantially concentric with the other plane loop or loops.

5. A multi-channel uniform output type transformer according to claim 1 or 2, wherein a plurality of said plane loop are formed on said printed circuit substrate, and each of said plane loops is formed by each of said flat cable belts and arranged in deviated parallel relationship with the other plane loop or loops.

6. A multi-channel uniform output type transformer according to claim 1 or 2, wherein said core is an EI type core and said plane loop is provided at the farthest position from a gap of said core.

7. A multi-channel uniform output type transformer according to claim 1 or 2, wherein a flat type cable connector is fixed on said substrate and at least one end portion of said flat cable belt is connected to said connector.

8. A multi-channel uniform output type transformer according to claim 1, or 2, wherein axial type diodes of the same number as the number of said multiple output channels are substantially vertically installed and fixed on said substrate and one lead pin of said diode on the cathode side or on the anode side is installed on said substrate while the other lead pin is connected to each conductor of one end portion of said flat cable belt.

9. A multi-channel uniform output type transformer according to claim 8, wherein diodes of the same number as said number of output systems are integrated in a line for each diode of an appropriate number to be divided into a plurality of diode rows, wherein each diode row is vertically provided on said substrate at appropriate intervals in parallel, with each other, and wherein one end portion of said flat cable belt is appropriately cut, and each of said conductors is connected to a predetermined diode of said appropriate diode rows.

10. A multi-channel uniform output type transformer according to claim 6, wherein said substrate is supported by the winding shaft portion of said core, and said plane loop is arranged on said circuit substrate surface.

11. A multi-channel uniform output type transformer, comprising a primary winding and a secondary winding wound round a winding shaft portion of a core, for outputting uniformly balanced voltage from each of output channels, wherein:

said primary winding is a primary sheet coil comprising one printed circuit formed in a loop shape or in a helical shape on a substrate;

said secondary winding is a secondary sheet coil comprising printed patterns formed on both front and back surface of said substrate in such a manner that one ends of the printed patterns on said front surface are located directly above one ends of the printed patterns of said back surface of said substrate;

said printed patterns on said both surfaces are connected with each other via throughholes each made at said one ends of said printed patterns to form a coil pattern;

said coil patterns can be seen in a transparent view like the printed patterns on the front surface of said substrate are folded upon said printed pattern on the back surface at said one of the said both printed patterns via said throughholes;

said primary sheet coil and said secondary sheet coil are arranged so as to substantially orthogonally placed about said winding shaft of said core.

12. A multi-channel uniform output type transformer according to claim 11, wherein a plurality of said secondary sheets are arranged in multi-layers and said printed patterns of each secondary sheet are connected with each other via throughholes to form coil patterns corresponding to the number of output channels.

13. A multi-channel uniform output type transformer according to claim 11 or 12, wherein when said coil patterns on both surfaces of said substrate can be seen in a transparent view, a number of times of the folding of said printed patterns at places of said throughholes in said secondary sheet coil is set to an odd number.

14. A multi-channel uniform output type transformer according to any of claims 11 or 12, wherein when said coil patterns on both surfaces of said substrate can be seen in a transparent view, the printed circuit pattern of said secondary sheet coil is a line symmetrical diagram.

15. A multi-channel uniform output type transformer according to any of claims 11 or 12, wherein said primary sheet coil is pinched between said two secondary sheet coils and the distance between each sheet coil is made constant.

16. A multi-channel uniform output type transformer according to claim 15, wherein the printed circuit patterns of said two secondary sheet coils for pinching said primary sheet coil therebetween are plane-symmetrical to each other with respect to said primary sheet coil.

17. A multi-channel uniform output type transformer according to claim 15, wherein lead pins vertically provided on terminal portions of printed circuits for said primary sheet coil and said two secondary sheet coils respectively, substantially vertically pass through the substrate surfaces of other sheet coils, and said lead pins and said substrates are appropriately fixed at said through positions, whereby the distance between said sheet coils is maintained constant.

18. A multi-channel uniform output type transformer according to claim 15, wherein said primary sheet coil is arranged in coincidence with the position of a gap of said core.

19. A multi-channel uniform output type transformer according to claim 18, wherein the printed circuit patterns of said two secondary sheet coils for pinching said primary sheet coil therebetween are plane-symmetrical to each other with respect to said primary sheet coil.

20. A multi-channel uniform output type transformer according to claim 18, wherein lead pins vertically provided on terminal portions of printed circuits for said primary sheet coil and said two secondary sheet coils respectively, substantially vertically pass through the substrate surfaces of other sheet coils, and said lead pins and said substrates are appropriately fixed at said through positions, whereby the distance between said sheet coils is maintained constant.

21. A multi-channel uniform output type transformer according to claim 11, wherein plane packaging type diodes of the same number as the number of output channels are packaged on one surface of the substrate of said secondary sheet coil, and wherein one lead terminal of said diode on the cathode side or on the anode side is connected to a portion corresponding to the end portion of the secondary winding on the packaged surface.

22. A multi-channel uniform output type transformer according to claim 21, wherein lead terminals for anode and cathode of each of said diodes are connected to one and other end of said secondary winding, respectively, via throughholes.

* * * * *